US008235679B2

(12) United States Patent
Nyzen et al.

(10) Patent No.: US 8,235,679 B2
(45) Date of Patent: Aug. 7, 2012

(54) CAM BEARING FLOW CONTROL FOR ROTATING CAM RING VANE PUMP

(75) Inventors: Robert Nyzen, Hiram, OH (US); Martin A. Clements, North Royalton, OH (US)

(73) Assignee: Eaton Industrial Corporation, Cleveland, OH (US)

( * ) Notice: Subject to any disclaimer, the term of this patent is extended or adjusted under 35 U.S.C. 154(b) by 249 days.

(21) Appl. No.: 12/640,843

(22) Filed: Dec. 17, 2009

(65) Prior Publication Data

US 2011/0150682 A1 Jun. 23, 2011

(51) Int. Cl.
*F04C 15/00* (2006.01)

(52) U.S. Cl. ..... 417/220; 417/228; 417/366; 418/26; 418/102; 418/259

(58) Field of Classification Search ..... 417/220, 417/228, 366; 418/26–29, 259, 102, 30, 418/31; 384/100, 101–124
See application file for complete search history.

(56) References Cited

U.S. PATENT DOCUMENTS

2006/0099100 A1* 5/2006 Clements et al. ..... 418/173
2006/0269423 A1* 11/2006 Clements et al. ..... 417/219

* cited by examiner

*Primary Examiner* — Devon C Kramer
*Assistant Examiner* — Dominick L Plakkoottam
(74) *Attorney, Agent, or Firm* — Fay Sharpe LLP

(57) ABSTRACT

A pump assembly includes a housing having a chamber in communication with an inlet and an outlet. A rotating ring, variable displacement vane pump is received in the chamber. The pump, and particularly the rotating ring, is supported by a fluid bearing in the chamber. A control is provided for selectively altering fluid flow to the bearing in response to one of hydrodynamic bearing pressure, boost flow pressure, and the pump stroke.

15 Claims, 2 Drawing Sheets

CAM BEARING FLOW CONTROL FOR ROTATING CAM RING VANE PUMP

BACKGROUND OF THE DISCLOSURE

This disclosure relates to a variable displacement pump, and more particularly relates to a rotating cam ring vane pump that employs a fluid bearing to support the cam ring.

Current rotating ring vane pumps use a cam ring fluid or journal bearing fed with high pressure from the pumping element. This journal bearing acts as a combination hydrostatic and hydrodynamic bearing. The cam ring that is supported by the bearing is driven by friction between the cam ring at the interface with the vanes. At low speeds, typically on the order of approximately twenty percent (20%) of maximum speed or less, the friction generated between the vanes and cam ring is not high enough to start rotation of the cam ring. When the cam ring is not rotating, mechanical efficiency is reduced. This, coupled with the reduced volumetric efficiency due to leakage through the cam bearing ring, will result in the pumping element sizing point at a low speed condition, typically on the order of less than ten percent (10%) of maximum speed.

The physical size and weight of the pump are important to the system design. It is desirable to minimize the pump flow capacity in order to minimize physical size and weight. In many fuel systems that incorporate positive displacement type pumps, pump flow capacity is set either at engine take-off conditions or at engine start conditions. Sizing the pump flow capacity at the take-off condition minimizes physical size and weight of the unit. Sizing at engine start conditions is typically an outcome of the level of parasitic internal leakage of the fuel system.

As fuel system parasitic internal leakage is a controllable quantity by specific system design, the minimization of that leakage will result in a pump sized at the more desirable take-off condition. Cam bearing flow forms part of the fuel system parasitic leakage quantity. Therefore, elimination of the cam bearing flow at low speeds, such as windmill engine start, helps achieve pump sizing at the take-off condition. Curtailing of cam bearing flow leads to higher pump flow capacity at specific operating conditions; therefore, the engine start condition is provided as a representative condition for curtailing cam ring bearing flow and could be performed at any condition in which extra pump flow capacity is desired.

While curtailing cam ring bearing flow in effect increases the pumping system volumetric efficiency, it can be accompanied by a significant loss in mechanical efficiency. Further, the gain in volumetric efficiency can be outweighed by the loss in mechanical efficiency and thus results in a lower overall pump efficiency. For this reason, the selectable application of cam ring bearing flow is desired.

In an ever increasing need to improve efficiency, manufacturers are seeking to reduce the weight of individual components where ever possible. Selectable application of cam ring bearing flow leads to optimization of pump performance over the wide range of operating conditions typically encountered by a variable displacement device. Accordingly, re-design of the system and operation of the fuel pump can result in significant savings.

SUMMARY OF THE DISCLOSURE

A pump assembly includes a housing having a chamber in communication with an inlet and an outlet. A rotating ring, variable displacement vane pump is received in the chamber.

The pump, and particularly the rotating ring, is supported by a fluid bearing in the chamber. A control is provided for selectively altering fluid flow to the bearing in response to one of hydrodynamic bearing pressure, boost flow pressure, and the pump stroke.

Preferably, the control limits fluid to the bearing when hydrodynamic pressure is low.

The control limits fluid to the bearing, for example, during thermal pinch points of system operation, start-up, and take-off.

In an exemplary embodiment, the control includes a flow valve having pressure surfaces communicating with discharge pressure from a boost pump and with the inlet pressure from the boost pump.

In another preferred embodiment, the control is responsive to hydrodynamic pressure.

In still another preferred arrangement, the flow valve is located within a pressure plate of the housing.

The control may alternately include a solenoid valve that communicates with boost discharge pressure and pump discharge pressure for regulating the supply of cam bearing fluid to the pump, or in still another arrangement, the control is responsive to pump stroke.

A method of reducing pump sizing requirements includes providing a housing having a chamber with a pump inlet and pump outlet, a rotating ring variable displacement vane pump in the chamber, supporting the pump in the chamber with a fluid bearing, and selectively altering fluid to the bearing in response to one of hydrodynamic bearing pressure, boost flow pressure, and the pump stroke.

A primary benefit is the ability to significantly reduce pump sizing requirements.

Another associated benefit relates to the decreased weight associated with the size reduction of the pump.

Still another benefit is found in the ability to selectively regulate fluid flow to a fluid bearing supporting the cam ring.

Still another benefit is that when the system requires substantially all the flow, such as at a full stroke position, then flow to the cam ring bearing can be significantly reduced or terminated.

Still other features and benefits of the present disclosure will become more apparent upon reading and understanding the following detailed description.

DETAILED DESCRIPTION OF THE PREFERRED EMBODIMENTS

Figure 1:
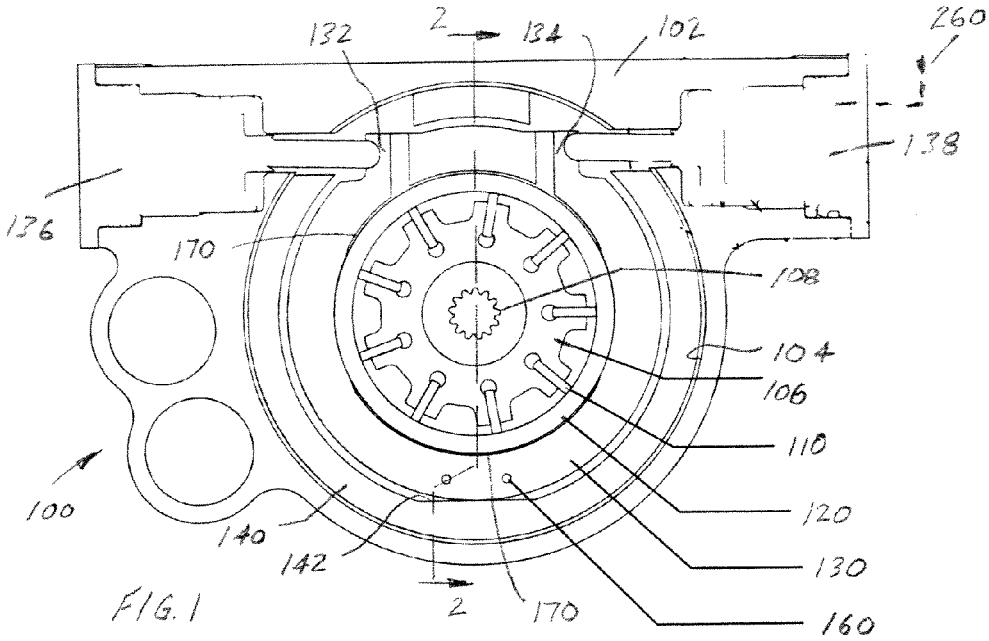
FIG. 1 is a cross-sectional view through a variable displacement vane pump that employs a rotating cam ring supported by a fluid bearing.
Figure 2:
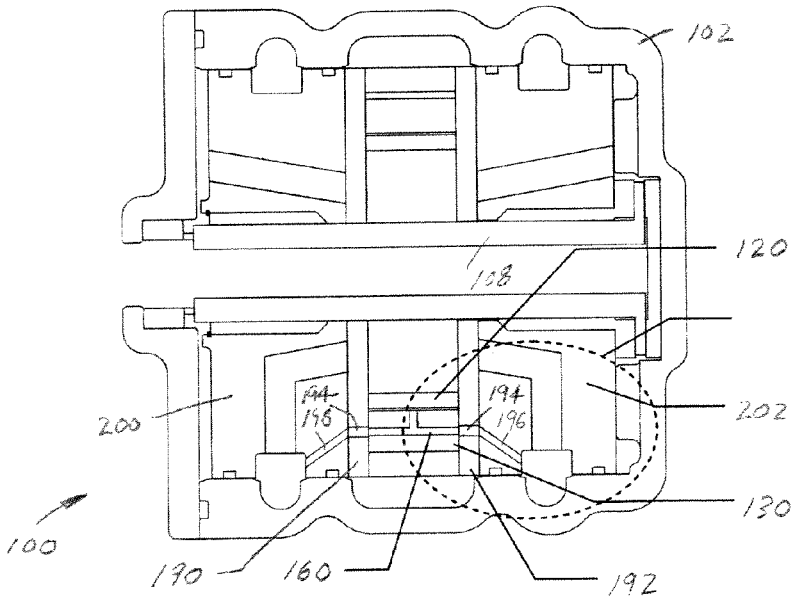
FIG. 2 is cross-sectional view taken generally along the lines 2-2 of FIG. 1.

FIGS. 1 and 2 generally illustrate a rotating ring variable displacement vane pump 100 having a housing 102 in which is formed a pump chamber 104 that communicates with an inlet and outlet so that a fluid, such as jet fuel, is provided to the inlet and pressurized in the chamber for distribution through the pump outlet to downstream uses (not shown) in the aircraft system. Rotor 106 is mounted for rotation on a drive shaft such as splined shaft 108. At circumferentially spaced locations on the outer perimeter of the rotor are provided a series of slots that receive a respective vane 110, the vanes moving in a generally radial direction within each slot relative to the remainder of the rotor as the rotor rotates in the pump chamber. Individual, circumferentially spaced pockets are defined externally of the rotor and between adjacent vanes to pump the fluid through the chamber from the inlet to the outlet. Although nine vanes are shown in the illustrated pump, the disclosure should not be limited to the particular number of vanes or the illustrated arrangement.

Surrounding the vanes and rotor is a cam ring 120 that is free to rotate within a cam sleeve 130. The cam sleeve includes first and second lobes or actuating surfaces 132, 134 that cooperate with first and second actuator assemblies 136, 138 to selectively alter the pump stroke. The cam sleeve 130 rolls relative to a spacer ring 140, and more particularly rolls along a generally planar or flat surface 142 thereof. The extension or retraction of the actuator assemblies 136, 138 provide for selective movement of the cam sleeve which, in turn, alters the stroke or displacement of the pump in a manner well known in the art. The cam ring is supported within the pump chamber, and more particularly within cam sleeve 130, by a journal bearing 170 filled with pump fluid, here jet fuel. The journal bearing 170 defines a hydrostatic, hydrodynamic, or a hybrid hydrostatic/hydrodynamic bearing.

Since frictional forces are developed between outer tips of the vanes and the rotating cam ring, the cam ring will rotate within the cam sleeve 130 at the same speed, slightly greater, or at a slightly lesser speed than the vanes of the rotor. In other words, the cam ring is free to rotate relative to the rotor since there is no structural component interlocking the cam ring for rotation with the rotor. As a result of being supported by the fluid film bearing 170, the cam ring 120 possesses a much lower magnitude viscous drag, which would otherwise lead to mechanical losses and reduced pump efficiency. The improved efficiency offered by the journal bearing 170 is one desired feature of the present pump.

In order to supply the cam bearing fluid to the journal bearing 170, feed holes 160 extend through the cam sleeve 130 and communicate with the journal bearing 170 (see FIG. 2). Port plates 190, 192 (FIG. 2) are provided on opposite sides of the rotor, and include passages 194 there through that communicate with the cam bearing feed holes 160 at one end and with passages 196 in pressure plates 200, 202 at opposite ends. More particular details of the structure and operation of such a pump may be found in commonly owned U.S. Pat. No. 7,108,493, the details of which are hereby incorporated by reference.

Figure 3:
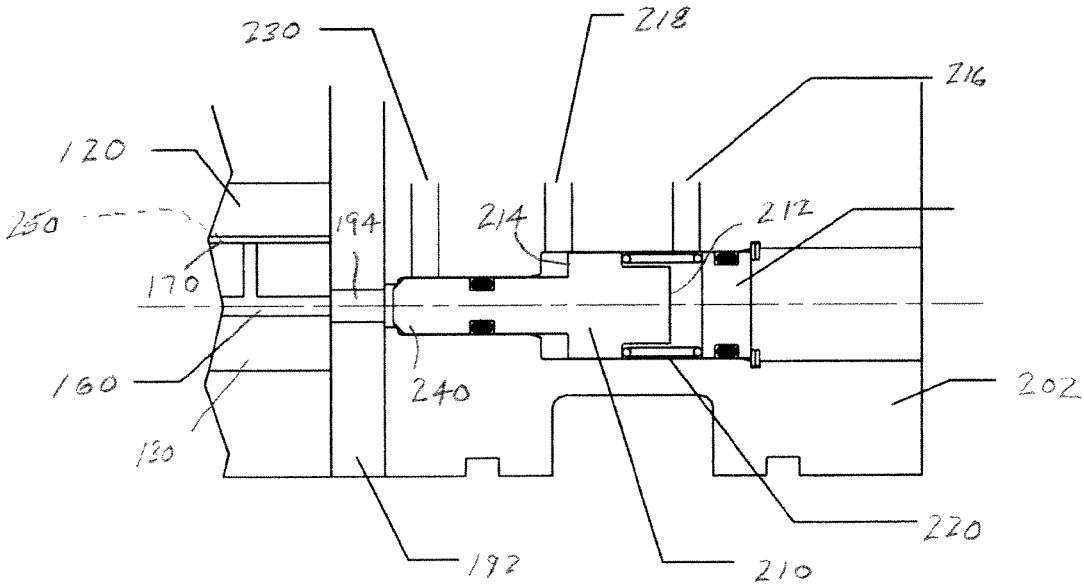
FIG. 3 is an enlarged cross-sectional view showing incorporation of a cam bearing flow valve in a pressure plate for regulating flow to the cam bearing.

FIG. 3 shows a proposed arrangement that will selectively turn-off or regulate the cam bearing flow in response to preselected conditions. More particularly, a valve such as spool valve 210 has pressure surfaces or sense lands 212, 214 that communicate with boost inlet pressure through passage 216 and with boost discharge pressure through passage 218, respectively. Biasing member, such as spring 220, urges the spool in a direction that precludes communication between passage 230 that communicates with pump discharge pressure and cam bearing feed hole 160 through the intermediate passage 194 in the port plate. In the preferred arrangement, the valve assembly is located in the encircled area of FIG. 2, that is the valve arrangement is located in pressure plate 202.

At low boost stage pressure rise, the pump speed will be low and cam bearing flow is not necessary. Thus, passage 218 is at a sufficiently low pressure so that the resultant force acting on surface 214 is insufficient to overcome the bias of the spring 220 and the force acting on valve surface 212 supplied with the boost inlet pressure through passage 216. In this manner, end 240 of the spool valve shuts off communication between pump discharge pressure passage 230 that supplies pump pressure to the passages 194, 160 that feed the cam bearing fluid.

At high boost stage pressure rise, the pump speed will be high and the cam bearing flow is necessary to the function of the rotating ring vane pump. As a result, the spool valve 210 moves rightwardly to an open position allowing communication between passage 230 and passage 194 the supplies the cam bearing feed holes 160 associated with the fluid bearing.

An alternative arrangement is to monitor hydrodynamic pressure of the journal bearing. This is represented by dotted line 250 in FIG. 3. The previously described arrangement monitors the change in pressure across the boost stage, which necessarily requires a relatively large valve because there is not an associated large change in the pressure across the boost pump. Hydrodynamic pressure on the other hand exhibits a large pressure rise, and therefore a smaller valve can be used because of the large force margins associated with the pressure rise. In turn, the valve can be reduced in dimension because of the use of higher hydrodynamic pressure via a suitable monitoring path 250 and resulting in associated control of the bearing fluid supply to the cam bearing feed passages 160.

Dotted line 260 in FIG. 1 is representative of another pump condition or parameter that may be monitored for determining when to potentially regulate or cut-off bearing flow to the journal bearing. Particularly, line 260 is representative of monitoring the pump stroke. Here, a valve can be actuated off of the pump stroke 260 as detected by the position of one of the actuating assemblies. The valve can be simplified between full flow and shut-off positions regarding the bearing flow, or be a more complex valve arrangement that regulates the bearing flow to the journal bearing. When the pump is in need of all flow possible, the pump is positioned at full stroke. In such a condition the cam ring bearing fluid flow can be terminated. Again, this pump parameter is easily detected or sensed for example at the actuator assemblies that vary the displacement stroke of the pump. Such information can be used in a valve that controls flow to the bearing feed passages.

Figure 4:
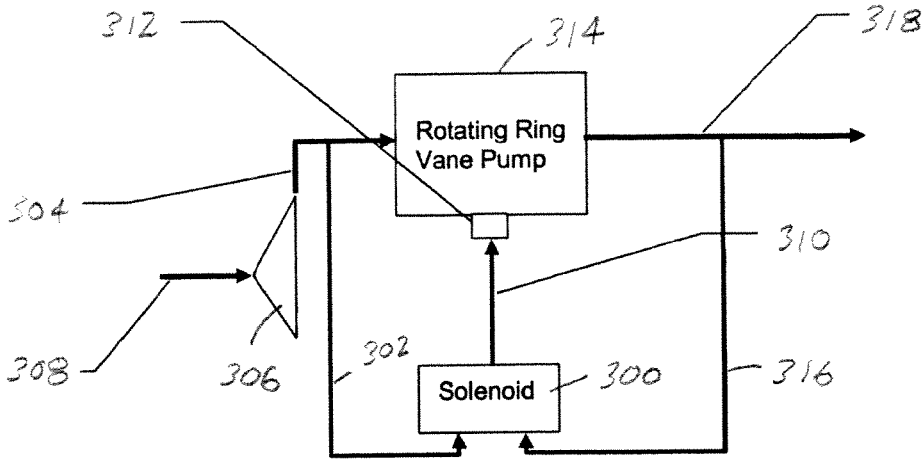
FIG. 4 is a schematic representation of use of a solenoid for controlling cam bearing supply.

FIG. 4 is a schematic representation of using solenoid 300 to turn on or off cam bearing flow. For example, one embodiment of a preferred solenoid valve selects whether or not high pressure is supplied to the bearing. This is achieved with a simple three-way solenoid valve. Alternatively, the solenoid valve 300 selects between supplying low pressure or high pressure to the cam ring bearing. More particularly, low pressure is supplied through passage 302 that communicates with the boost discharge pressure 304 from the upstream boost pump 306 which pressurizes inlet pressure provided to the boost pump at inlet passage 308. The solenoid 300 may communicate the boost discharge pressure from line 302 to the cam bearing supply passage 310 associated with an external port 312 schematically represented on a rotating ring vane pump 314 of the type described above. Alternately, high pressure from passage 316 receives pump discharge pressure in line 318 which can be alternately communicated through the three-way solenoid valve 300 to cam bearing supply passage 310. Thus, the solenoid valve advantageously selects whether or not to supply low or high pressure to the bearing.

Of course, one skilled in the art will recognize that other external valve arrangements could be incorporated. Without unduly limiting the present disclosure, other valve arrangements may include an electro-hydraulic servo valve or spool valve arrangement similar to that shown in FIG. 3 but located externally of the pumping element. The electro-hydraulic servo valve and spool valve arrangements also permit active control of the cam bearing flow to any desired quantity.

In summary, a proposed device selectively turns off or regulates cam bearing flow at various operating conditions such as low speeds. The cam ring that rides in the bearing is driven by the friction between the cam ring and the vanes of the pump. At low speeds, typically less than twenty percent (20%) of the maximum speed, the friction generated between the vanes and cam ring is not high enough to start rotation of the cam ring and therefore cam ring bearing flow is not required. Reduction or elimination of the bearing flow at low speed conditions increases the volumetric efficiency of the pumping element, thus resulting in a smaller required pump displacement for a given flow and thus allows the sizing point of the pumping system to be at the more desirable take-off condition. This, in turn, reduces the package size and weight. At higher speeds, the proposed device will turn on the cam bearing flow. At higher speeds, the cam bearing flow is required to properly operate the bearing and thus the rotating ring vane pump.

The disclosure has been described with reference to the preferred embodiments. Modifications and alterations will occur to others upon reading and understanding this specification. It is intended to include all such modifications and alterations in so far as they come within the scope of the appended claims or the equivalents thereof.

Having thus described the invention, we claim:

1. A pump assembly comprising:

a housing having a chamber that is in communication with an inlet and an outlet; a rotating ring variable displacement vane pump received in the chamber for imparting energy to fluid in the chamber;

a fluid bearing supporting the pump in the chamber; and a control for selectively altering fluid to the bearing that includes a flow valve having pressure surfaces communicating with discharge pressure from a boost pump and with inlet pressure from the boost pump.

2. The assembly of claim 1 wherein the control limits fluid to the bearing when hydrodynamic pressure is low.

3. The assembly of claim 2 wherein the control limits fluid to the bearing during thermal pinch points of system operation, start-up, and take-off.

4. The assembly of claim 1 wherein the flow valve is located within a pressure plate of the housing.

5. The assembly of claim 1 wherein the flow valve is biased toward a closed position.

6. The assembly of claim 1 wherein the flow valve is a solenoid valve that communicates with boost discharge pressure and pump discharge pressure.

7. The assembly of claim 6 wherein the solenoid valve regulates the supply of cam bearing fluid to the pump.

8. A pump assembly comprising:

a housing having a chamber that is in communication with an inlet and an outlet;

a rotating ring variable displacement vane pump received in the chamber for imparting energy to fluid in the chamber;

a fluid bearing supporting the pump in the chamber; and wherein the pump stroke is monitored and actuates a valve regulating fluid flow to the cam bearing in response thereto.

9. A method of operating a pump comprising:

providing a housing having a chamber in communication with a pump inlet and a pump outlet;

rotating a ring vane variable displacement pump in the chamber for imparting energy to fluid in the chamber;

supporting the pump in the chamber with a fluid bearing; and selectively altering fluid to the bearing using a valve that is responsive to the boost flow pressure for controlling fluid supply to the fluid bearing.

10. The method of claim 9 further including limiting fluid to the bearing during thermal pinch points of system operation, start-up, and take-off.

11. The method of claim 9 further including limiting fluid to the bearing when hydrodynamic pressure is low.

12. The method of claim 9 wherein the valve has pressure surfaces communicating with discharge pressure from a boost pump and with inlet pressure from the boost pump.

13. The method of claim 12 further including locating the valve within the pump.

14. The method of claim 13 further including locating the valve within a pressure plate of the housing.

15. A method of operating a pump comprising:

providing a housing having a chamber in communication with a pump inlet and a pump outlet;

rotating a ring vane variable displacement pump in the chamber for imparting energy to fluid in the chamber;

supporting the pump in the chamber with a fluid bearing; and selectively altering fluid to the bearing including monitoring the pump stroke and actuating a valve regulating fluid flow to the cam bearing in response thereto.

* * * * *